US006443742B2

(12) United States Patent
Ishikawa

(10) Patent No.: US 6,443,742 B2
(45) Date of Patent: Sep. 3, 2002

(54) PRINTED CIRCUIT BOARD-CONNECTING CONNECTOR WITH ADJUSTABLE CONNECTIONS

(75) Inventor: Tatsuya Ishikawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/742,329

(22) Filed: Dec. 22, 2000

(30) Foreign Application Priority Data

Dec. 22, 1999 (JP) ..... 11-364283
Nov. 29, 2000 (JP) ..... 2000-363357

(51) Int. Cl.[7] ..... H01R 12/00
(52) U.S. Cl. ..... 439/79; 439/83; 439/838
(58) Field of Search ..... 439/79, 59, 62, 439/842, 852, 787, 835, 838, 151, 166, 170, 889

(56) References Cited

U.S. PATENT DOCUMENTS 4,762,500 A * 8/1988 Dola et al. ..... 439/79
5,256,072 A * 10/1993 Hatagishi ..... 439/79
5,468,154 A * 11/1995 Yip et al. ..... 439/79
5,591,036 A 1/1997 doi et al. ..... 439/79
5,692,912 A * 12/1997 Nelson et al. ..... 439/79
5,971,774 A * 10/1999 Kuki et al. ..... 439/79
5,980,328 A 11/1999 Takanashi et al. ..... 439/733.1

FOREIGN PATENT DOCUMENTS

EP 428 359 A1 5/1991

* cited by examiner

*Primary Examiner*—Renee Luebke
*Assistant Examiner*—Briggitte R. Hammond
(74) *Attorney, Agent, or Firm*—Morgan, Lewis & Bockius LLP

(57) ABSTRACT

At least one connection terminal (12) includes a contact portion (40) which is insertable in at least one receiving chamber (CV) of a connector housing (10), and a distal end portion (12a) which is electrically connectable to a conductive circuit pattern formed on a printed circuit board. A spacer block (14) is fittable to the connector housing (10), the spacer block (14) having a pair of upper and lower passage windows (24), which are disposed correspondingly to the at least one receiving chamber (CV) of the connector housing (10) and symmetrically with respect to a center axis ($CL_2$) of the contact portion (40) received in the at least one receiving chamber (CV). The distal end portion (12a) of the at least one connection terminal (12) is passable through and retainable a position thereof at one of the upper and lower passage windows (24).

15 Claims, 6 Drawing Sheets

PRINTED CIRCUIT BOARD-CONNECTING CONNECTOR WITH ADJUSTABLE CONNECTIONS

BACKGROUND OF THE INVENTION

1. Field of the Invention

The present invention relates to a multi-pole connector for mounting on a surface of a printed circuit board. More particularly, the present invention relates to a structure of a female connection terminal soldered to the surface of the printed circuit board.

The present application is based on Japanese Patent Application Nos. Hei. 11-364283 and 2000-363357, which are incorporated herein by reference.

2. Description of the Related Art

A typical example of related multi-pole connectors, mounted on a surface of a printed circuit board, is shown in FIG. 12 which is an exploded perspective view thereof and in FIG. 13 which is a perspective view of the connector of FIG. 12 in its assembled condition. As shown in FIGS. 12 and 13, the connector comprises a housing 1, female connection terminals 2 and a spacer block 3. The housing 1 has two (upper and lower) rows of connection ports 1*a*, into which male connection terminals (not shown) are insertable, formed in a front surface thereof in a longitudinal direction. The female connection terminals 2 are press-shaped products of an electrically-conductive metal sheet, and are receivable in receiving chambers (not shown) disposed inwardly of the connection ports 1*a*. The spacer block 3 is fittable into an opening (not shown) formed in a rear surface of the housing 1 generally over an entire area thereof.

The spacer block 3 includes, flange portions 4 which are formed respectively at opposite ends thereof and have screw holes respectively, a bar-like fitting portion 5 which extends between the two flange portions 4 and can be fitted in the opening in the rear surface of the housing 1, and engagement plates 7 which extend respectively from the flange portions 4 and can be engaged with lock piece portions 6 formed at opposite ends of the housing 1. Ribs 5*a* are projected on upper and lower surfaces of the fitting portion 5. For partitioning the receiving chambers into plural sections, these ribs 5*a* cooperate with an inner peripheral surface of an opening formed in the rear surface of the housing 1, so that two (upper and lower) rows of narrow spaces are formed.

Distal end portions 2*a* of the female connection terminals 2, received respectively in the inner receiving chambers, are passed respectively through the aforementioned narrow spaces, and these distal end portions 2*a*, extending outwardly from the spacer block 3, are soldered respectively to predetermined portions of a surface of a printed circuit board.

In the above connector, the female connection terminals 2 are densely arranged in two rows in a multi-pole manner, and therefore in the case where electrically-conductive circuit pattern portions are wide, the number of the female connection terminals need to be reduced in accordance with the width of the conductive circuit pattern portions such that the female connection terminals are arranged at increased intervals. As a result, there has been encountered a disadvantage that dead spaces are formed in the printed circuit board-connecting connector.

The number of such dead spaces tends to further increase in the case where the conductive circuit pattern has an intersection circuit or a short-circuit, and when assembling the connector, it has been difficult to confirm whether or not all of the required female connection terminals 2 are inserted.

SUMMARY OF THE INVENTION

The present invention has been made in order to solve the above problems, and an object of the present invention is to provide a printed circuit board-connecting connector which has a high space efficiency, and achieves a high degree of freedom of a board design, and can be easily assembled.

To achieve the above object, according to the first aspect of the present invention, there is provided a connector which comprises a connector housing, at least one receiving chamber formed within the connector housing, at least one connection terminal including a contact portion which is insertable in the at least one receiving chamber of the connector housing, and a distal end portion which is electrically connectable to a conductive circuit pattern formed on a printed circuit board, and a spacer block fittable to the connector housing, the spacer block having a pair of upper and lower passage windows, which are disposed correspondingly to the at least one receiving chamber of the connector housing and symmetrically with respect to a center axis of the contact portion of the at least one connection terminal received in the at least one receiving chamber, wherein the distal end portion of the at least one connection terminal is passable through and retainable a position thereof at one of the upper and lower passage windows when the contact portion of the at least one connection terminal is inserted in the at least one receiving chamber and the spacer block is fitted to the connector housing.

According to the second aspect of the present invention, it is preferable that the distal end portion of the at least one connection terminal is passable through and retainable a position thereof at the other one of the upper and lower passage windows when the contact portion of the at least one connection terminal is rotated at an angle of 180° about the center axis thereof and inserted in the at least one receiving chamber and the spacer block is fitted to the connector housing.

In the above connector, the distal end portion of the connection terminal can be selectively projected through and from one of the upper and lower passage windows of the spacer block. Accordingly, provided that there are a plurality of connection terminals, a plurality of corresponding receiving chambers and upper and lower rows of passage windows, the arrangement of the distal end portions of the connection terminals (that is, the interval between the adjacent distal end portions for each row of passage windows) can be changed in accordance with the width of line portions of the electrically-conductive circuit pattern and the design of this circuit pattern, while using the connection terminals of the same configuration. Therefore, the use of any of the connection terminals does not need to be omitted, and hence all of the receiving chambers are efficiently used, and an installation space for the connector can be made small, and an operation for confirming whether or not all of the connection terminals are mounted can be carried out easily, so that the efficiency of the assembling operation is enhanced. And besides, the degree of freedom of a board design can be greatly increased.

According to the third aspect of the present invention, it is preferable that a mating terminal is insertable into the contact portion of the at least one connection terminal at a generally center in height of the contact portion in such a condition that the at least one connection terminal is received in the at least one receiving chamber.

According to the fourth aspect of the present invention, it is preferable that the at least one connection terminal further includes a side piece portion which is formed stepwise on the contact portion, and from which the distal end portion is extended, and wherein a distance, at which the distal end portion is spaced from the center axis of the contact portion, is longer than a distance at which a circumference of the contact portion is spaced from the center axis thereof.

According to the fifth aspect of the present invention, it is preferable that the spacer block has positioning projections formed on a surface thereof to be opposed to the printed circuit board. Accordingly, the connector can be easily and accurately positioned relative to the printed circuit board by inserting the positioning projections respectively into holes formed in the printed circuit board.

DETAILED DESCRIPTION OF THE PREFERRED EMBODIMENT

One preferred embodiment of a printed circuit board-connecting connector of the present invention now will be described in detail with reference to FIGS. 1A to 11.

Figure 1A:
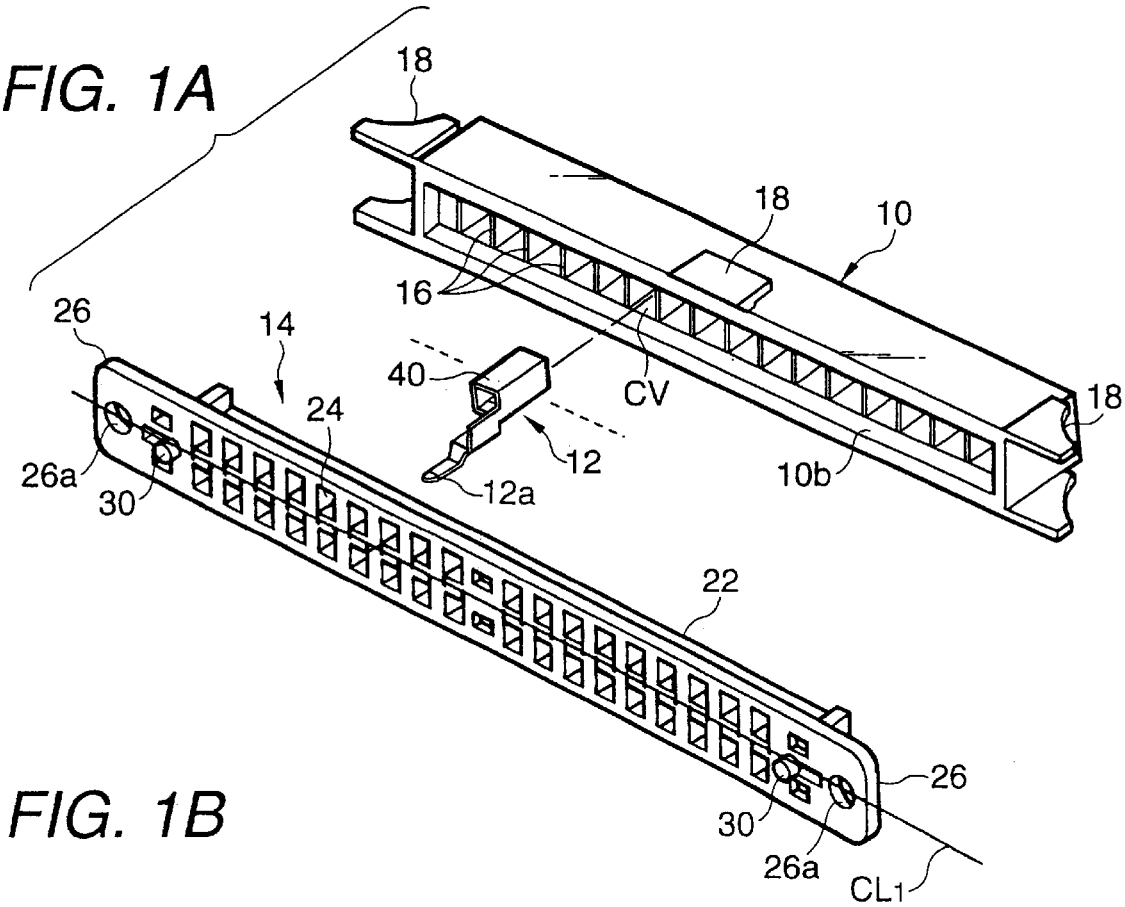
FIG. 1A is an exploded, perspective view of important portions of a printed circuit board-connecting connector of the present invention.
Figure 1B:
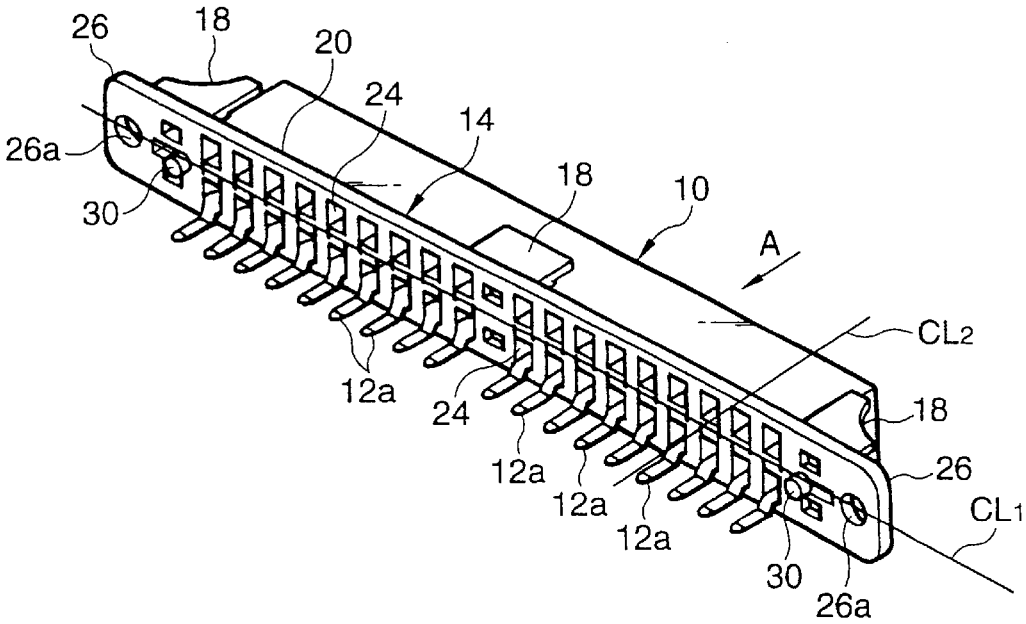
FIG. 1B is a perspective view of the important portions of the printed circuit board-connecting connector of the present invention in an assembled condition.

As shown in FIGS. 1A and 1B, the printed circuit board-connecting connector of the present invention comprises a connector housing 10, female connection terminals 12, and a spacer block 14. The connector housing 10 and the spacer block 14 are made of a resin material or the like. The female connection terminals 12 are press-shaped products of an electrically-conductive metal sheet. The spacer block 14 is fittable into the connector housing 10.

More specifically, the housing 10 has an elongate, rectangular shape, and includes a plurality of connection ports 10*a* (see FIG. 5), which are formed in that surface of the rectangular housing 10, facing away from the spacer block 14, and are arranged along a centerline $CL_1$ in a longitudinal direction. As shown in FIG. 1A, a plurality of partition walls 16 are formed within a space which is formed in the housing 10, and is disposed inwardly of the connection ports 10*a*, so that the space is divided into separate receiving chambers CV by the partition walls 16. A fitting opening 10*b*, which serves as a recess for receiving part of the spacer block 14, is formed in that surface of the housing 10, facing the spacer block 14, generally over an entire area of the housing 10 in a longitudinal direction thereof. Lock piece portions 18 for retaining the spacer block 14 are formed at opposite longitudinal ends and a central portion of the housing 10.

Figure 2:
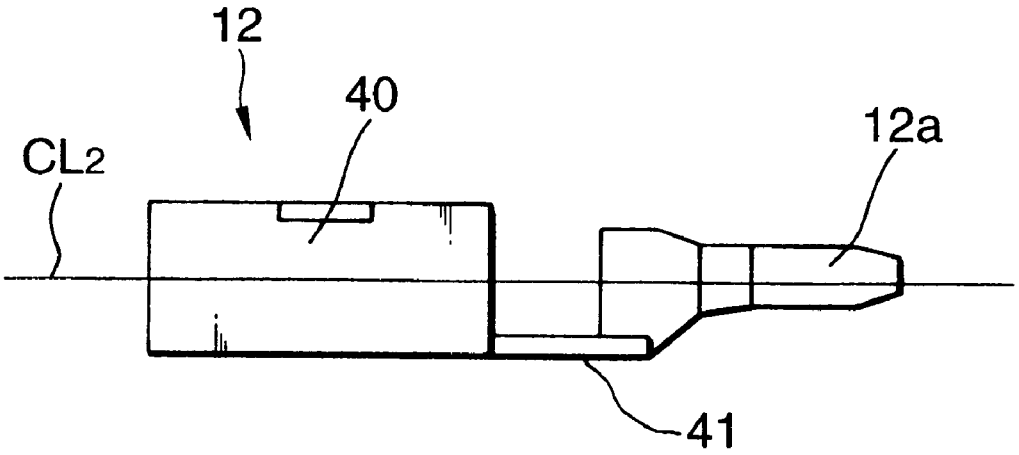
FIG. 2 is a plan view of a female connection terminal.
Figure 3:
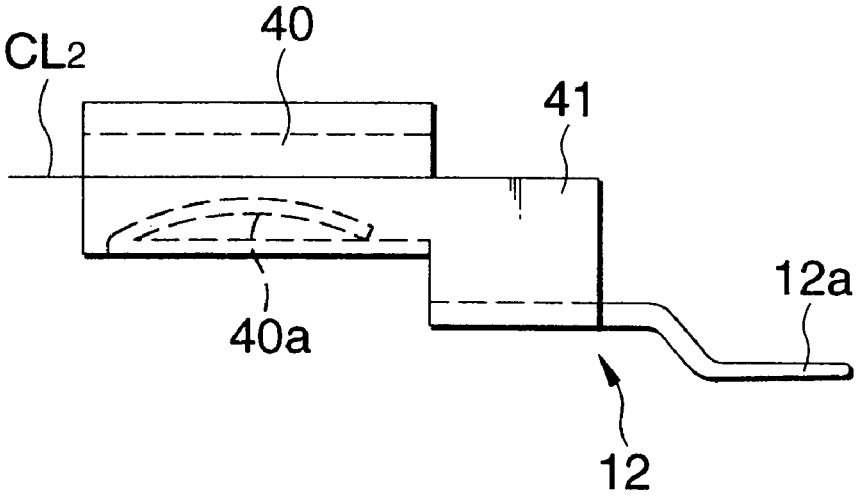
FIG. 3 is a side-elevational view of the female connection terminal.
Figure 4:
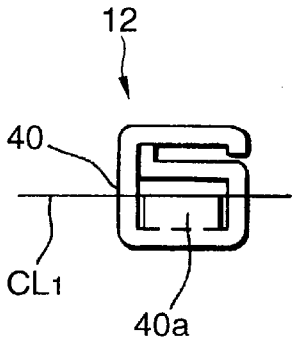
FIG. 4 is a front-elevational view of the female connection terminal.
Figure 5:
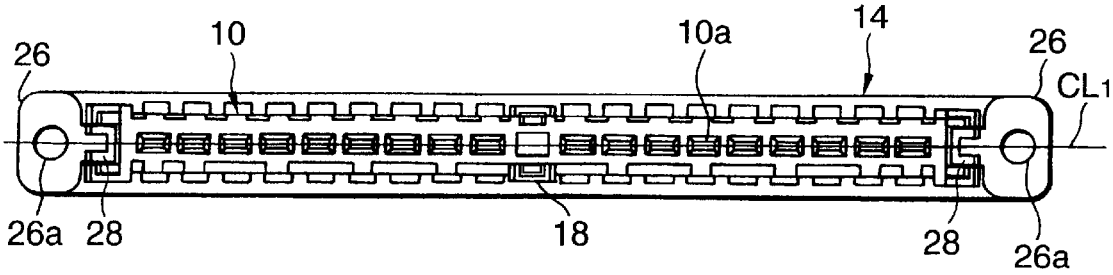
FIG. 5 is a view as seen in a direction of arrow A of FIG. 1B.

Each of the female connection terminals 12 has an integral construction formed by pressing. As shown in FIGS. 2 and 3, each of the female connection terminals 12 is mainly comprised of a contact portion 40, a side piece portion 41, and a distal end portion 12*a* which is connected to the contact portion 40 through the side piece portion 41. The distal end portion 12*a* is adapted to be electrically connectable to an electrically-conductive circuit pattern formed on a printed circuit board. The contact portion 40 can be inserted into one of the receiving chambers CV of the housing 10. The distal end portion 12*a* of the female connection terminal 12 is spaced from a center axis $CL_2$ of the contact portion 40 (see FIG. 3). More specifically, a distance, at which the distal end portion 12*a* is spaced from the center axis $CL_2$ of the contact portion 40, is designed to be longer than a distance at which a circumference of the contact portion 40 is spaced from the center axis $CL_2$ thereof. The contact portion 40 of the female connection terminal 12 is receivable in the receiving chamber CV of the housing 10 in such a condition that the distal end portion 12*a* of the female connection terminal 12 is located at a lower position as shown in FIGS. 1A and 1B, or in such a condition that the distal end portion 12*a* is located at an upper position in which the female connection terminal 12 is angularly moved or inverted from the condition of FIGS. 1A and 1B at an angle of 180° about the center axis $CL_2$ thereof. Therefore, the contact portion 40 has a hollow, rectangular shape symmetrical with respect to the center axis $CL_2$. As shown in FIGS. 3 and 4, a contact point portion 40*a* is provided within the contact portion 40 of the female connection terminal 12. The female connection terminal 12 is invertible such that in either of the above two conditions, the contact point portion 40*a* is spaced generally the same distance from the center axis $CL_2$ (see FIG. 3). Namely, the female connection terminal 12 is so designed that a tab of a mating male connection terminal can be inserted into the contact portion 40 at a substantially central position in the height of the contact portion 40 of the female connection terminal 12, that is, the male connection terminal can be inserted substantially in alignment with the center axis $CL_2$. In this embodiment, the contact point portion 40*a* is disposed near the middle of the height of the contact portion 40.

Figure 6:
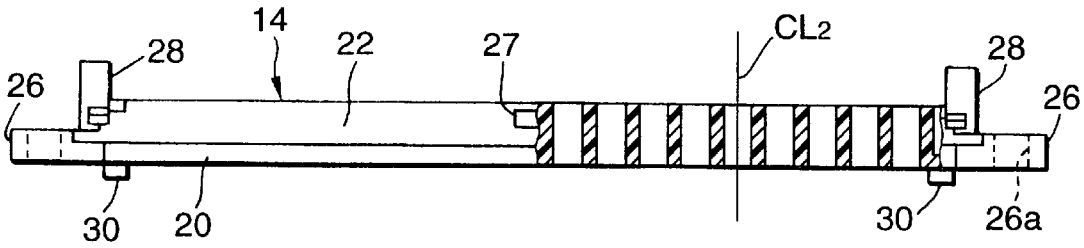
FIG. 6 is a partly-broken, side-elevational view of a spacer block of the printed circuit board-connecting connector of the present invention.
Figure 7:
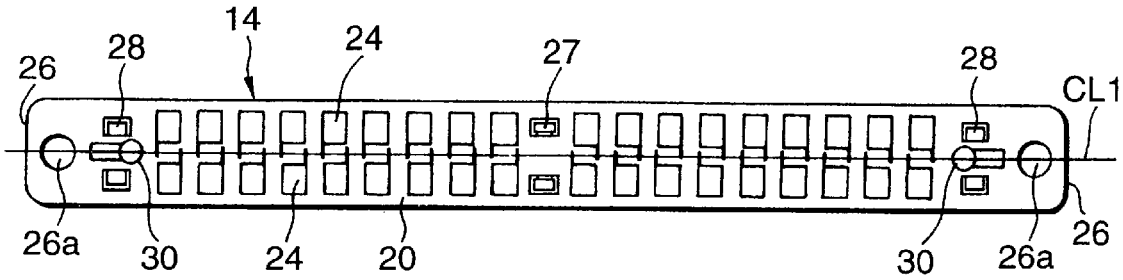
FIG. 7 is a bottom view of the spacer block of FIG. 6.
Figure 8:
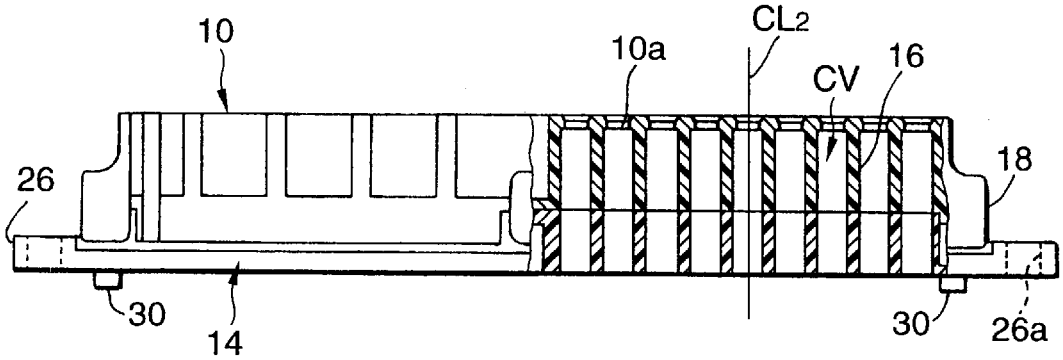
FIG. 8 is a partly-broken, side-elevational view of the printed circuit board-connecting connector of the present invention.

As shown in FIG. 6, the spacer block 14 includes a base bottom portion 20 and a fitting block portion 22. The base bottom portion 20 has a flat plate shape, and is larger in width than the housing 10. The fitting block portion 22 is formed on the base bottom portion 20, and extends along a centerline $CL_1$ of the base bottom portion 20. The fitting block portion 22 can be fitted into the fitting opening 10*b* formed in the housing 10. As shown in FIG. 7, two (upper and lower) rows of passage windows 24 are formed through the base bottom portion 20 in such a manner that each pair of upper and lower passage windows 24 can correspond to the distal end portion 12*a* of the associated female connection terminal 12 disposed in the condition in which the distal end portion 12*a* is located at the lower position as shown in FIG. 1, and the distal end portion 12*a* of this terminal 12 disposed in the condition in which the distal end portion 12*a* is inverted from the condition of FIG. 1 through the angle of 180° about the center axis $CL_2$ of the female connection terminal 12. Namely, two (upper and lower) passage windows 24 are provided for the one female connection terminal 12. In other words, each two (upper and lower) passage windows 24 are provided for one of the receiving chambers CV. Moreover, the two (upper and lower) rows of passage windows 24 are provided along the centerline $CL_1$ of the base bottom portion 20.

As shown in FIG. 6, engagement plates 28 are formed on and project from opposite ends of the fitting block portion 22. The engagement plates 28 are engageable with the respective lock piece portions 18 that are formed at the opposite longitudinal ends of the housing 10 (see FIGS. 1A and 1B). Further, flange portions 26 are formed respectively at opposite ends of the base bottom portion 20, and are located outwardly of the corresponding engagement plates 28. Screw holes 26*a* are formed through the flange portions 26, respectively, and the flange portions 26 are fixedly secured to the printed circuit board 100 by screws passing respectively through the screw holes 26*a*. Furthermore, protrusions 27 are formed at a central portion of the fitting block portion 22. The protrusions 27 are engageable with the respective lock piece portions 18 that are formed at the central portion of the housing 10 in the longitudinal direction thereof.

Positioning projections 30 are formed on the reverse surface of the spacer block 14 to be opposed to the printed circuit board. The positioning projections 30 are inserted respectively into holes formed respectively through predetermined portions of the printed circuit board so that the spacer block 14 is fixed, and by doing so, the printed circuit board-connecting connector can be easily and accurately positioned relative to the printed circuit board.

In the printed circuit board-connecting connector, the contact portions 40 of the female connection terminals 12 are inserted respectively into the receiving chambers CV of the housing 10. In this condition, the contact portions 40 are positioned by the receiving chambers CV. Then, the fitting block portion 22 is fitted into the fitting opening 10*b* in such a manner that the side piece portions 41 of the female connection terminals 12 are respectively received in chambers, formed in the fitting block portion 22 and communicating with the passage windows 24, and the distal end portions 12*a* of the female connection terminals 12 are passed respectively through the corresponding passage windows 24 of the base bottom portion 20. By doing so, the assemblage of the connector is completed as shown in FIG. 1B.

The printed circuit board-connecting connector of the present invention fully achieves its effects in the cases where the electrically-conductive circuit pattern on the printed circuit board has any one of the following designs.

Figure 9:
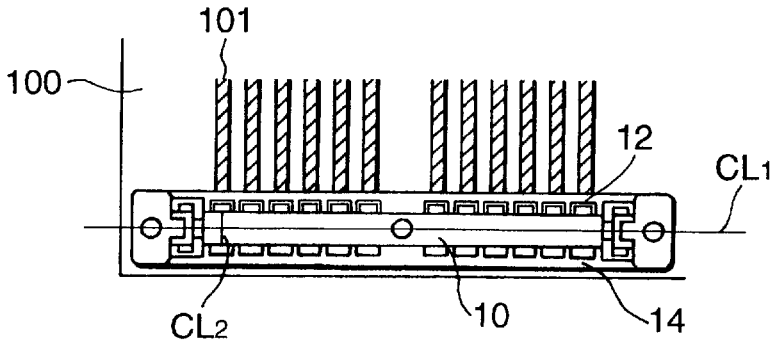
FIG. 9 is a plan view showing one example of connection of the printed circuit board-connecting connector of the present invention.

First, in the case where line portions of a conductive circuit pattern 100 have a small width as shown in FIG. 9, the female connection terminals 12 are inserted respectively into the receiving chambers CV through the fitting opening 10*b* in such a manner that the contact portions 40 of all of these terminals 12 are disposed at the same angular position with respect to the center axis $CL_2$. With this arrangement, the conductive circuit pattern is formed only at one side of the connector, and therefore an installation space for the connector can be made small, and the connector can be fixed in a stable manner even when the connector is to be fixed to that portion of the printed circuit board in close proximity to an end portion of this board.

Figure 10:
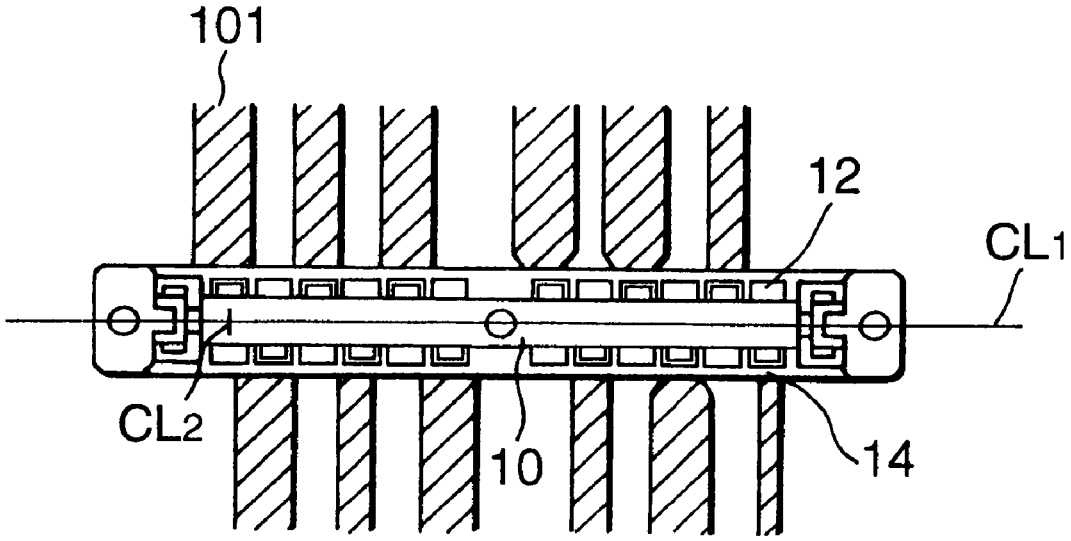
FIG. 10 is a plan view showing another example of connection of the printed circuit board-connecting connector of the present invention.

In the case where line portions of a conductive circuit pattern 101 have a large width as shown in FIG. 10, the female connection terminals 12 are received respectively in the receiving chambers CV in such a manner that the female connection terminals 12 are, for example, alternately inverted about the center axis $CL_2$. With this arrangement, the use of any of the female connection terminals does not need to be omitted, and the connector can be effectively used with a high space efficiency.

Figure 11:
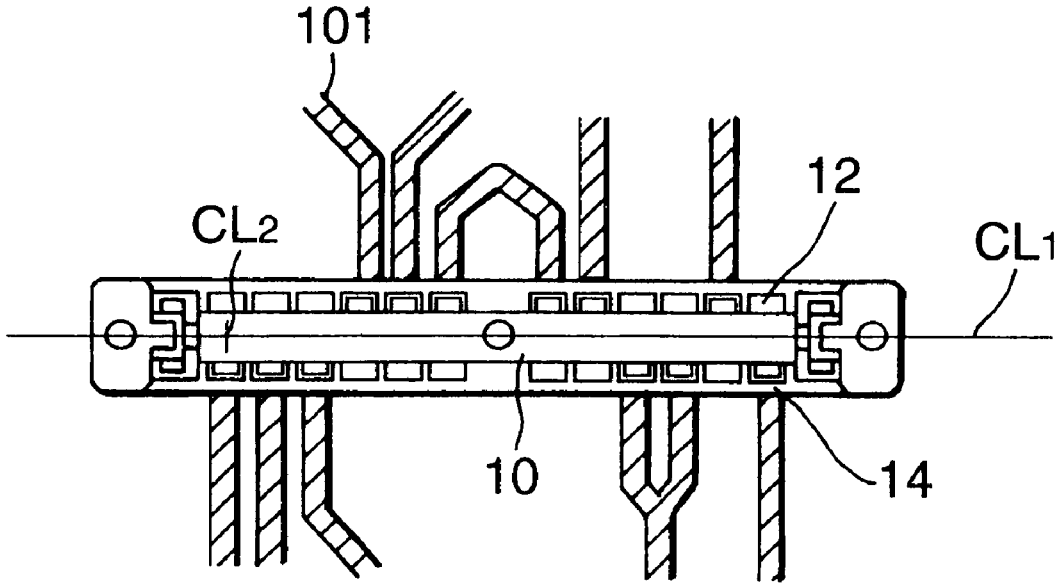
FIG. 11 is a plan view showing a further example of connection of the printed circuit board-connecting connector of the present invention.
Figure 12:
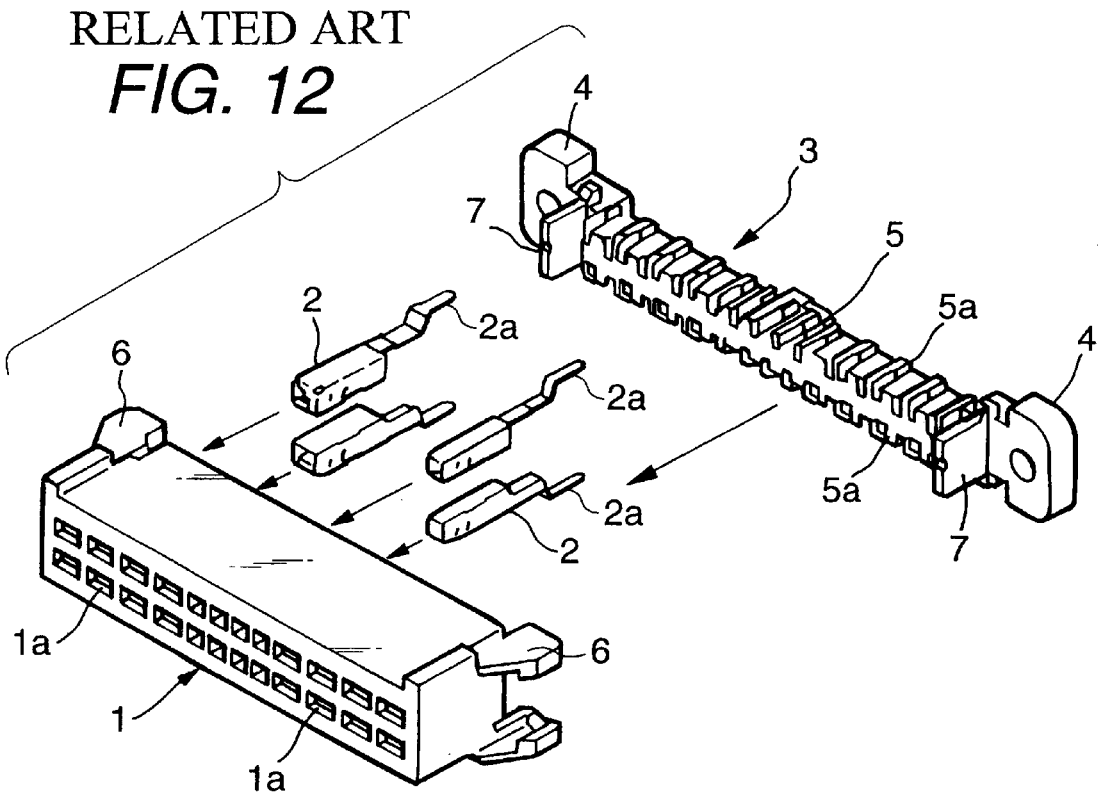
RELATED ART FIG. 12
FIG. 12 is an exploded, perspective view of important portions of a related printed circuit board-connecting connector.
Figure 13:
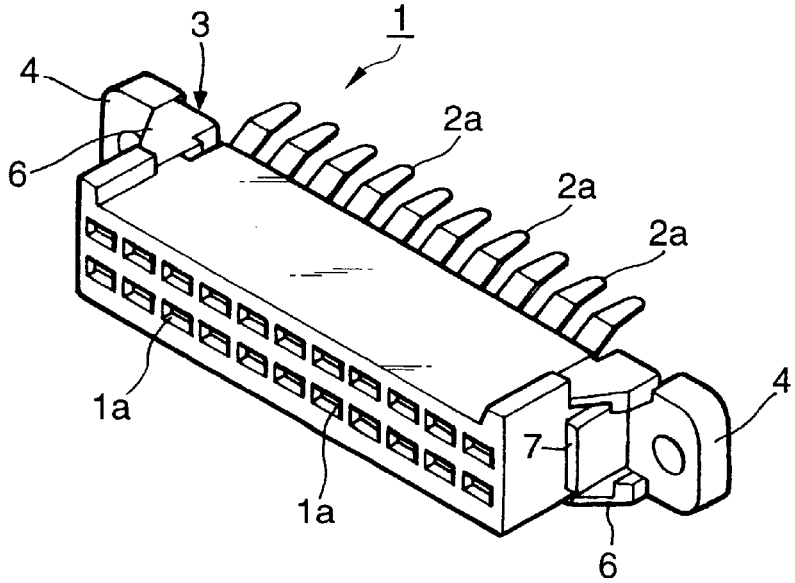
FIG. 13 RELATED ART
FIG. 13 is a perspective view of the important portions of the related printed circuit board-connecting connector.

In the case where a conductive circuit pattern 101 has intersection circuits or short-circuits as shown in FIG. 11, the female connection terminals 12 are received respectively in the receiving chambers CV in such a manner that predetermined ones of these female connection terminals 12 are inverted about the center axis $CL_2$ while the other female connection terminals 12 are disposed at the same angular position with respect to the center axis $CL_2$. With this arrangement, the soldering portions can be formed at either side of the connector, and the degree of freedom of the board design can be increased.

Thus, the female connection terminals of the same configuration can be used for all of the above conductive circuit patterns, and the versatility of the printed circuit board-connecting connector can be enhanced, and therefore the cost can be reduced. And besides, any of the receiving chambers CV is not to be kept empty, and therefore the omission of the female connection terminal 12 from any of the receiving chambers CV in the housing 10 is prevented. Therefore, the reliability of the connector, as well as the efficiency of the connector-assembling operation, can be enhanced.

And besides, the spacer block is formed into a flat plate-shape as a whole, and therefore the flexural rigidity of the connector is enhanced, and the area of contact of the spacer block 14 with the printed circuit board is increased. Therefore, the whole of the connector can be firmly fixed to the printed circuit board.

Therefore, in the present invention, there can be provided the printed circuit board-connecting connector which overcomes the problems of the related construction, and has the relatively-compact construction, and can be easily assembled.

In the printed circuit board-connecting connector of the present invention, the distal end portion of each of the connection terminals can be passed through one of each pair of upper and lower passage windows in the spacer block. Therefore, the arrangement of the distal end portions of the connection terminals can be changed in accordance with the width of the line portions of the electrically-conductive circuit pattern and the design of this circuit pattern, while using the connection terminals of the same configuration. Therefore, the use of any of the connection terminals does not need to be omitted, and hence all of the receiving chambers are efficiently used, and the installation space for the connector can be made small, and the operation for confirming whether or not all of the connection terminals are mounted can be carried out easily, so that the efficiency of the assembling operation is enhanced. And besides, the degree of freedom of the board design can be greatly increased.

In the printed circuit board-connecting connector of the present invention, the spacer block has the positioning projections formed on the reverse surface thereof to be opposed to the printed circuit board, and therefore the connector can be easily and accurately positioned relative to the printed circuit board by inserting the positioning projections respectively into holes formed in the printed circuit board.

What is claimed is:

1. A connector, comprising:

a connector housing;

at least one receiving chamber formed within the connector housing;

at least one connection terminal including a contact portion which is insertable in the at least one receiving chamber of the connector housing, and a distal end portion which is electrically connectable to a conductive circuit pattern formed on a printed circuit board; and a spacer block fittable to the connector housing, the spacer block having a pair of upper and lower passage windows, which are disposed correspondingly to the at least one receiving chamber of the connector housing and symmetrically with respect to a center axis of the contact portion of the at least one connection terminal received in the at least one receiving chamber, wherein the distal end portion of the at least one connection terminal is passable through and retainable in the upper passage window when the contact portion of the at least one connection terminal is inserted in the at least one receiving chamber in a first position and the spacer block is fitted to the connector housing, and is passable through and retainable in the lower passage window when the contact portion is rotated on the center axis to a second position and is inserted in the at least one receiving chamber and the spacer block is fitted to the connector housing.

2. The connector of claim 1, wherein the spacer block has positioning projections formed on a surface thereof to be opposed to the printed circuit board.

3. The connector of claim 1, wherein between the first and second positions the contact portion of the at least one connection terminal is rotated at an angle of 180° about the center axis thereof and inserted in the at least one receiving chamber and the spacer block is fitted to the connector housing.

4. The connector of claim 3, wherein the at least one connection terminal further includes a side piece portion which is formed stepwise on the contact portion, and from which the distal end portion is extended, and wherein a distance, at which the distal end portion is spaced from the center axis of the contact portion, is longer than a distance at which a circumference of the contact portion is spaced from the center axis thereof.

5. The connector of claim 3, wherein the spacer block has positioning projections formed on a surface thereof to be opposed to the printed circuit board.

6. The connector of claim 1, wherein, in a condition where the at least one connection terminal is received in the at least one receiving chamber, a mating terminal is insertable into the contact portion of the at least one connection terminal at a generally center in height of the contact portion.

7. The connector of claim 6, wherein that at least one connection terminal further includes a side piece portion which is formed stepwise on the contact portion, and from which the distal end portion is extended, and wherein a distance, at which the distal end portion is spaced from the center axis of the contact portion, is longer than a distance at which a circumference of the contact portion is spaced from the center axis thereof.

8. The connector of claim 6, wherein the spacer block has positioning projections formed on a surface thereof to be opposed to the printed circuit board.

9. The connector of claim 3, wherein, in a condition where the at least one connection terminal is received in the at least one receiving chamber, a mating terminal is insertable into the contact portion of the at least one connection terminal at a generally center in height of the contact portion.

10. The connector of claim 9, wherein the at least one connection terminal further includes a side piece portion which is formed stepwise on the contact portion, and from which the distal end portion is extended, and wherein a distance, at which the distal end portion is spaced from the center axis of the contact portion, is longer than a distance at which a circumference of the contact portion is spaced from the center axis thereof.

11. The connector of claim 1, wherein the at least one connection terminal further includes a side piece portion which is formed stepwise on the contact portion, and from which the distal end portion is extended, and wherein a distance, at which the distal end portion is spaced from the center axis of the contact portion, is longer than a distance at which a circumference of the contact portion is spaced from the center axis thereof.

12. The connector of claim 11, wherein the spacer block has positioning projections formed on a surface thereof to be opposed to the printed circuit board.

13. A connector comprising:

a connector housing including a receiving chamber extending along a central axis;

a spacer block being fittable to the connector housing, the spacer block having an upper passage window and a lower passage window, the upper and lower passage windows being disposed correspondingly to the receiving chamber of the connector housing and symmetrically with respect to the central axis of the receiving chamber;

a connection terminal including a contact portion and a distal end portion, the contact portion being insertable in the receiving chamber of the connector housing; and the distal end portion of the connection terminal passing through a first one of the upper and lower passage windows when the contact portion of the connection terminal is inserted in the receiving chamber in a first position and when the spacer block is fitted to the connector housing, and the distal end portion of the connection terminal passing through a second one of the upper and lower passage windows when the contact portion of the connection terminal is inserted in the receiving chamber in a second position and when the space block is fitted to the connector housing, the connection terminal being rotated on the central axis between the first and second positions of the connection terminal.

14. The connector according to claim 13, wherein the distal end portion of the connection terminal is adapted to be electrically connectable to a conductive circuit pattern formed on a printed circuit board.

15. The connector of claim 13, wherein the contact portion of the connection terminal is rotated at an angle of 180° about the central axis between the first and second positions and inserted in the receiving chamber and the spacer block is fitted to the connector housing.

* * * * *